United States Patent [19]

Dittmar

[11] 4,106,383

[45] Aug. 15, 1978

[54] REGISTER ARRANGEMENT FOR AN ELECTRONIC MUSICAL INSTRUMENT

[75] Inventor: Wilfried Dittmar, Halsenbach, Fed. Rep. of Germany

[73] Assignee: WERSI-electronic GmbH & Co. Kommanditgesellschaft, Halsenbach, Fed. Rep. of Germany

[21] Appl. No.: 747,735

[22] Filed: Dec. 6, 1976

[30] Foreign Application Priority Data

Dec. 6, 1975 [DE] Fed. Rep. of Germany ..... 2555083

[51] Int. Cl.[2] ..... G10H 1/02; G10H 5/00

[52] U.S. Cl. ..... 84/1.01; 84/1.03; 84/1.24; 84/1.25; 84/DIG. 12

[58] Field of Search ..... 84/1.01, 1.03, 1.24, 84/1.25, DIG. 2, DIG. 4, DIG. 5, DIG. 12, DIG. 22, DIG. 23

[56] References Cited

U.S. PATENT DOCUMENTS

| | | | |
|---|---|---|---|
| 3,725,560 | 4/1973 | Robinson et al. | 84/1.01 |
| 3,844,192 | 10/1974 | Brand et al. | 84/1.01 |

*Primary Examiner*—Stanley J. Witkowski
*Attorney, Agent, or Firm*—Peter K. Kontler

[57] ABSTRACT

A register arrangement is provided for an electronic musical instrument (such as an electronic organ) whereby the various functional units of the instrument are actuated by electronic selector switches each one of which in turn has a control conductor to which control voltage can be applied by a register assembly either individually or as part of a preselected grouping of functional units.

17 Claims, 7 Drawing Figures

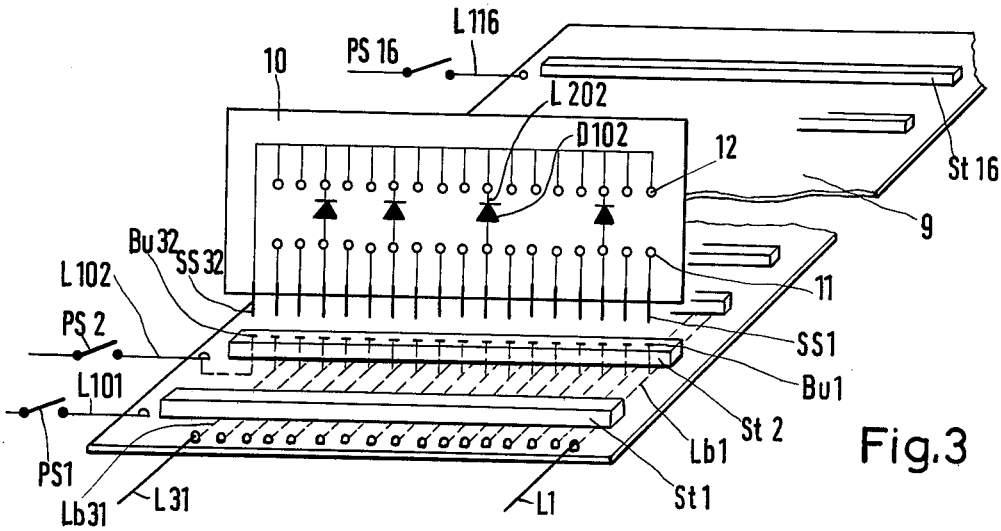
Fig.3
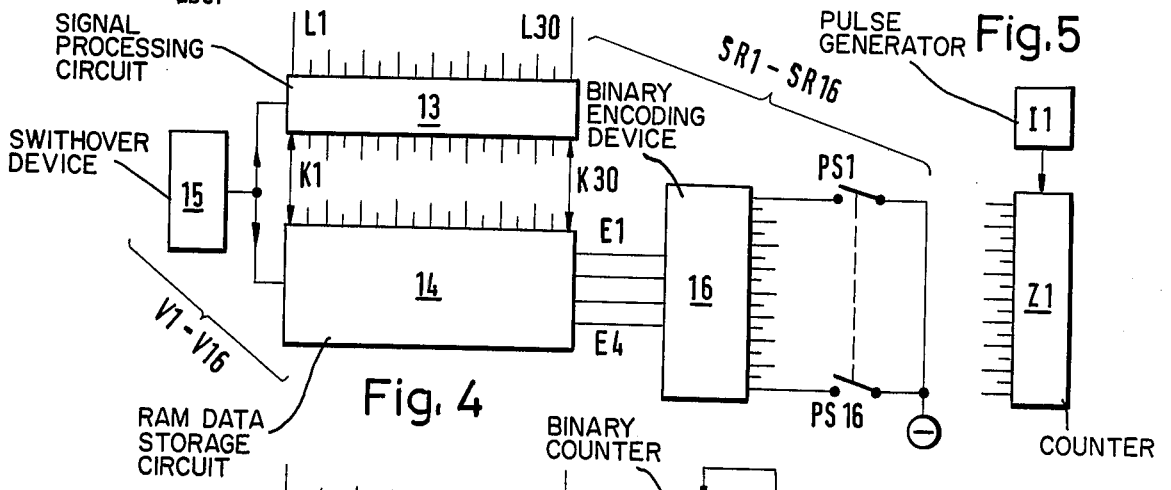
Fig. 4
Fig.5
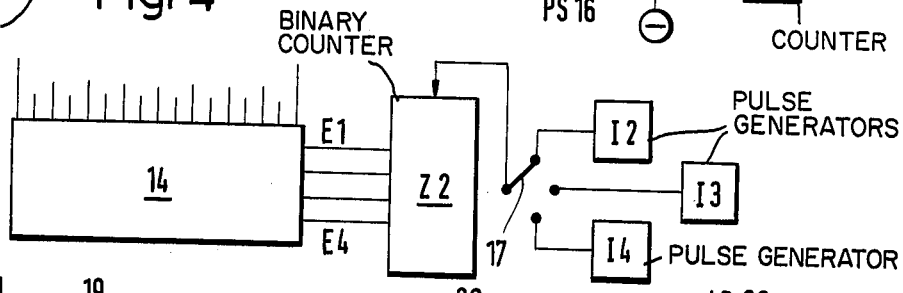
Fig.6
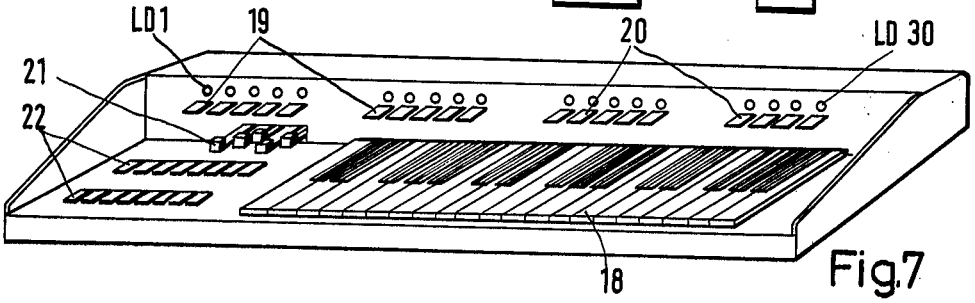
Fig.7

REGISTER ARRANGEMENT FOR AN ELECTRONIC MUSICAL INSTRUMENT

BACKGROUND OF THE INVENTION

The present invention relates to electronic musical instruments and in particular to a register arrangement for such instruments by which tone signal generation is influenced electronically rather than manually.

Sophisticated electronic musical instruments, such as electronic organs, may comprise a large number of functional units which in various ways affect the output tone signal of the instrument. A group of such units serve to provide tone formation and effects. For example, by means of suitable filters one could impart to square or saw tooth signals a selected upper wave content thereby producing a desired tone color. Similarly by employing appropriate envelope wave circuits tremolo or vibrato, percussion, piano or other effects can be achieved. Appropriate voltage regulation may also be utilized to produce still other desired effects.

Where the instrument has fixed stops for several footages as well as sine generators operated by drawbars on the instrument, a further functional unit can serve for the combination of sinusoidal signals. These further functional units are actuated by manual selector switches (usually called "registering switches") which are connected to the corresponding functional units through appropriate conductors. A large number of selector switches are disposed in the path of the tone signal (to an amplifier which in turn is usually connected to a loudspeaker). The switches may be in the conductor connected to the amplifier or the ground return path.

In order to register such an instrument it has heretofore been necessary to actuate a large number of switches, for example, five selector switches for the fixed stops in various footages and the selector switches for any desired effects (i.e., echo, tremolo). This becomes tedious to the musician particularly if, during the performance of any particular piece, extensive changes in registration are required.

Because of the above, certain instruments have been provided with so-called "free combinations" which, by means of a manually operated switchover device connect the predetermined output of various filters in various footages with collecting points which are addressed by the switchover device. The shortcoming of this arrangement is that multiple loads are placed on the filters and tone signal sources so that a relatively low output voltage is generated. Also, in order to minimize the problem of cross talk the tone signal conductors to the switchover device must be physically short thereby causing packaging problems.

In view of the above, it is the principal object of the present invention to provide a register arrangement for electronic musical instruments which overcomes the above described problems and has a minimum effect on the tone signal.

SUMMARY OF THE INVENTION

The above and other beneficial objects and advantages are attained in accordance with the present invention by providing an electronic musical instrument having a plurality of functional units wherein each functional unit is associated with an electronic selector switch. The selector switch in turn has a control conductor to which control voltage can be applied by an individual register assembly actuating element. A plurality of collecting register assemblies is provided each having an actuating element and an associated distributor circuit. The collecting register assemblies are adapted to apply control voltage simultaneously to a preselected combination of selector switches.

The register arrangement employs electronic selector switches which can be turned on with uniform control voltages. The selector switches may comprise field-effect-transistors, CMOS analog switches or any other electronic switching elements.

Since each functional unit is associated with only a single selector switch, the overloading problem discussed above is eliminated as is the problem of multiple loading of filters. Similarly cross talk problems may be eliminated by physically placing each selector switch immediately adjacent to its associated functional unit. On the other hand, since the length of the control signal conductors is immaterial, if desired remote operation of the entire instrument registration can be achieved. The selector switches can be actuated individually (by the actuating elements of the individual register assembly) or a predetermined combination of selector switches can be actuated by the collecting register assembly actuating elements. Thus, the collecting register assemblies contain a number of register programs which can be rendered effective in response to the actuation of a single actuating element of the selected collecting register assembly.

Each distributor circuit is provided with means for changing the relationship between the actuating element of the respective collecting register assembly and the control conductors. This permits the register program to be freely selected. At least one distributor circuit associates the register actuating element to selector switches for the formation of tone signals as well as to other selector switches for the generation of tone effects. For example, a fixed stop "trumpet 8-foot" could be combined with a tremolo effect.

Also, since the length of the control conductors in accordance with the present invention is immaterial, the functional units and their selector switches may be placed at any desired location on the instrument.

Furthermore, at least one distributor circuit can associate the corresponding actuating element with selector switches for high as well as low footages. The register program can thus embrace not only the basic tones but also harmonics.

It is of particular advantage to insure that the actuating elements of the individual register assemblies comprise switches each of which connects a common supply conductor with one of the control conductors or way of a decoupling element, and that the actuating elements of the collecting register assemblies apply control voltage to such supply conductor or to the outputs of distributor circuits which are associated with the control conductors. In this manner, one can insure that, in turning on a register program, the selected collecting register assembly disenables the previously connected individual register assembly.

The application of control voltage to a control conductor can be effected directly or indirectly. A direct application of control voltage takes place when the actuating element of the collecting register assembly is a switchover device which can apply voltage to the common supply conductor or to the respective circuit. An indirect application of control voltage occurs when the common supply conductor is connected with a collecting conductor by an inverter which delivers control voltage and if the collecting conductor is actuated by the actuating element of the collecting register assembly simultaneously with the distributor circuit.

The distributor circuits can be assembled in a number of different ways. In a very simple embodiment, each distributor circuit comprises connecting conductors which are provided with decoupling elements and are connected with control conductors, and the actuating element of each collecting register assembly is a switch which applies control voltage to the connecting conductors.

In accordance with a preferred embodiment, each distributor circuit comprises at least one insertable card which includes an input for the application of control voltage in dependency on the actuating element of the collecting register assembly and outputs for connection with one control conductor each, as well as possibly an output for connection with the collecting conductor. Furthermore, a selected combination of outputs is connected with the input by means of bridge elements. The register program for an actuating element can be changed readily merely by removing the card and inserting a new one. New register programs are effected simply by having the input of a card connected with a different combination of outputs by way of the aforementioned bridge elements.

A very simple construction can be achieved by utilizing bridge elements in the form of decoupling diodes. Such elements then perform a dual function.

Alternately, the connecting conductors can be in the form of plugs or terminals or microswitches which connect, at the selected intersection points, input conductors (which supply control voltage in dependency on an actuating element) with output conductors which later are connected with control conductors. In each of the aforedescribed examples, one can render effective freely assemblable register combinations by resorting to a single one-pole collecting register switch.

It is further advisable to provide the distributor circuits in the form of a data storing device whose storing areas can be addressed by actuating elements of the collecting register assemblies whereby the storage areas accept, in the course of storage, information which corresponds to the combination of all control conductors to which voltage has been applied. During play, such information can be used to apply control voltage to each of the corresponding control conductors. By resorting to such data storing device, the desired register program is selected by means of the actuating elements of the individual register assembly and stored at an address which is determined by the actuating element of the selected collecting register assembly. When addressed, the stored program appears as control voltages which are applied to the corresponding control conductors.

The construction is particularly simple if the storing device is an RAM-data storage device which comprises a plurality of inputs/outputs each of which is associated with a control conductor and is connected thereto by way of a signal processing circuit. All the signal processing circuit has to do is to convert the signal level from the control voltage level to the information signal level.

Furthermore, the data storage device can comprise a number of addressing inputs which respond to binary signals. The arrangement then comprises a binary encoding device which converts each signal for an input of the data storage device into a binary signal. The signals are furnished from the actuating element of the corresponding collecting register assembly.

In the above constructions, the actuating elements of the collecting register assemblies can be consolidated into a counter which is driven by control switching impulses and successive outputs of which are connected with different inputs of the binary encoding device. It is further possible to consolidate the binary encoding device and the actuating elements of the collecting register assemblies into a binary counter which can be driven by control switching impulses and whose outputs are connected with different addressing inputs of the data storage device. When the counter receives an impulse, the next-following register program is turned on. The switching impulses can be generated in a number of ways; they can be initiated by hand, they can be furnished by a timer (clock) or they can be furnished by a rhythm device. It is also possible to use a selector disk which can be rotated to select a desired counter output.

It will be seen that the actuating elements need not be manually operated switches. Instead, one can resort to any manually or automatically actuated elements. It is advantageous to utilize switching elements which are responsive to the approach of or actual contact with a finger (touch control).

It is further advisable to connect each control conductor with a light-emitting device. When the actuating element of a collecting register assembly is operated and the individual registering is terminated as a result of such operation, the active register program cannot be recognized or discerned by observing the position of the actuating elements of the individual register assembly. This problem is solved by the provision of light-emitting devices. If the light-emitting devices are installed adjacent the actuating elements of the individual register assembly of the corresponding selector switch, it is merely necessary to position the light-emitting devices at an observable location on the instrument and apply suitable legends for the purpose of identification.

BRIEF DESCRIPTION OF THE DRAWINGS

In the accompanying drawings:

FIG. 3 shows a distributor circuit with insertable cards;

FIG. 4 shows a distributor circuit with data storing device;

FIG. 5 illustrates a modificationn of the means for feeding information to the data storage device;

FIG. 6 illustrates another modification of the means for feeding information to the data storage device; and FIG. 7 is a perspective view of a musical instrument which embodies the improved register arrangement.

DETAILED DESCRIPTION OF THE PREFERRED EMBODIMENT

Figure 1:
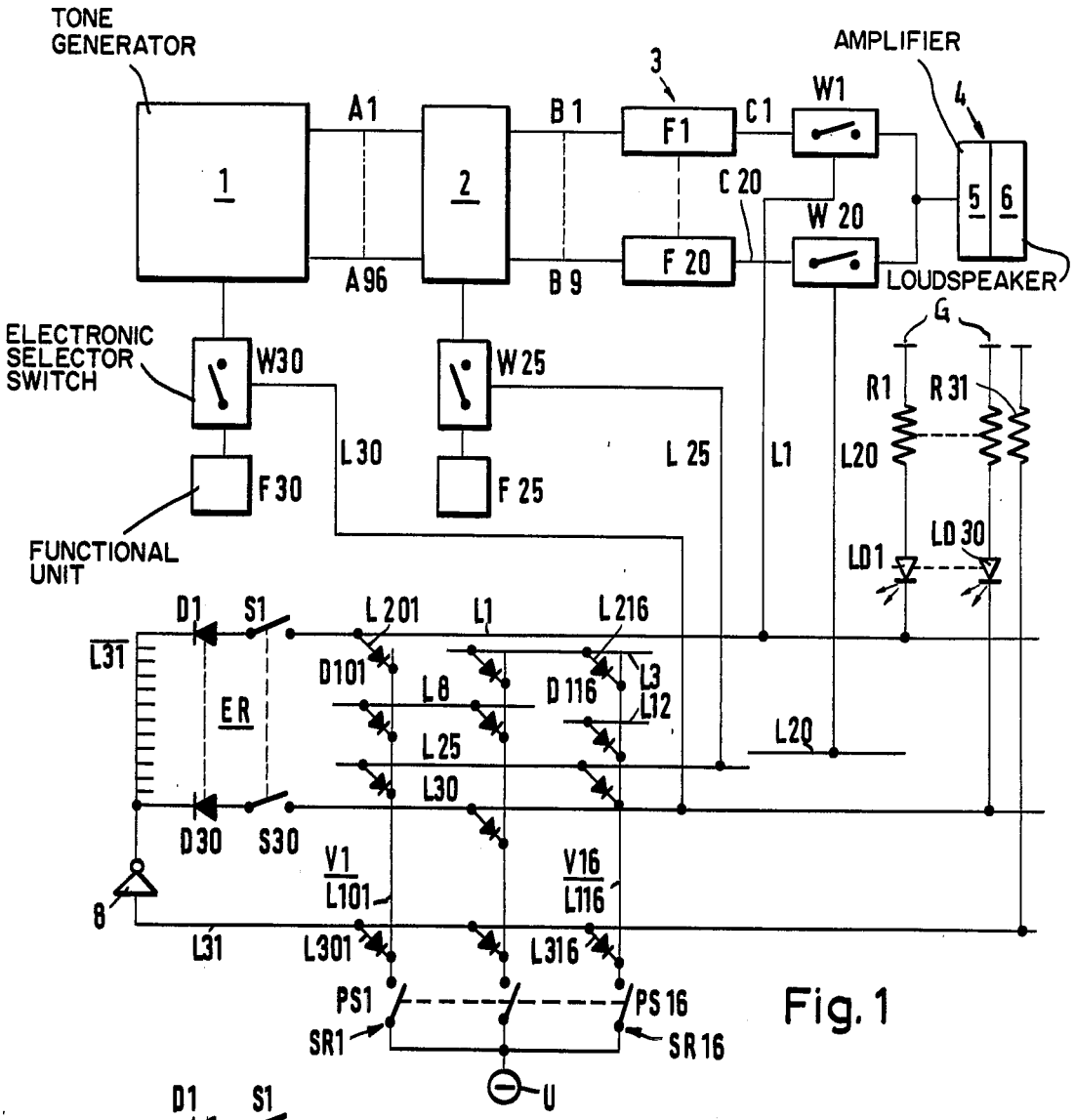
FIG. 1 is a diagrammatic view of an electronic musical instrument which embodies the improved register arrangement of the present invention.

The present invention is depicted in the accompanying drawings wherein similar components bear the same reference numerals throughout. The musical instrument of FIG. 1 comprises a tone generator 1 which may comprise, for example, eight octaves and thus includes 96 outputs A1 to A96. (Throughout the following description, wherever identical components such as "A1–A96" appear, a common prefix such as "A" has been provided). These outputs are connected with key-operated switches 2, for example, nine foot positions, i.e., there are a total of nine output conductors B1 to B9. The output conductors B1 to B9 are connected with a filter assembly 3 which may comprise 20 filters F1 to F20 having tone signal output conductors C1 to C20. The conductors C1 to C20 contain electronic selector switches W1 to W20. The conductors C1 to C20 are connected to each other between the selector switches W1 to W20 and an output unit generally designated 4 which includes an amplifier 5 and a loudspeaker 6.

The filter assembly 3 allows for the generation of tone signals in each of the various footages, e.g., 16, 8, 4, 2-⅔, 2, 1-3/5, 1-⅓ and 1 foot, to thus produce different tone colors. Furthermore, the tone signals can be influenced in order to produce special effects. To this end, the musical instrument comprises additional functional units. FIG. 1 shows, by way of example and only schematically, an envelope curve circuit F25 which can influence the amplitude of tone signals, for example, to achieve a percussion effect, and a voltage regulating circuit F30 which can vary the frequency of all tones of the tone generator 1, for example, to achieve a frequency vibrato. These functional units are rendered effective by means of electronic selector switches W25 and W30. All in all, there are provided 30 functional units F1 to F30 with associated selector switches W1 to W30.

The control conductors L1 to L30 of the electronic selector switches W1 to W30 are connected with the ground G by way of resistors R1 to R30 on the one hand, and with a common supply conductor $\overline{L31}$ on the other hand. The connection between the control conductors L1 to L30 and the common supply conductor $\overline{L31}$ includes actuating elements S1 to S30 (each of which may constitute a manually operable switch) and decoupling diodes D1 to D30. Light-emitting diodes LD1 to LD30 are connected between the resistors R1 to R30 and the control conductors L1 to L30. The light-emitting diodes are installed on the musical instrument close to the actuating components of the elements S1 to S30. The actuating elements S1 to S30 and the decoupling diodes D1 to D30 constitute an individual register assembly ER. The common supply conductor $\overline{L31}$ is connected with a collecting conductor L31 by way of an inverter 8.

The instrument further comprises several (e.g., 16) collecting register assemblies SR1 to SR16. Each collecting register assembly comprises an actuating element (PS1 to PS16) which may constitute a manually operated program switch which connects a source of negative control voltage U with a distributor circuit (V1 to V16). In the illustrated embodiment, each distributor circuit V1 to V16 has an input conductor (L101 to L116) and a series of similar connecting conductors (L201 to L216) each of which contains a decoupling diode (D101 to D116). Furthermore, each input conductor L101 to L116 is connected with the collecting conductor L31 by way of a connecting conductor (L301 to L316) which also contains a decoupling diode.

The operation of the circuit of FIG. 1 is as follows:

In the illustrated positions of the switches, one can, by depressing one or more actuating elements S1 to S30, apply control voltage from the source U to corresponding control conductors L1 to L30. This actuates the corresponding selector switches W1 to W30. If one of the actuating elements PS1 to PS16 is operated, the inverter 8 receives a signal so that the control voltage in the common supply conductor $\overline{L31}$ disappears. Thus, there is no further regulation by way of the individual register assembly ER. Instead, voltage is applied to those control conductors L1 to L30 which are connected with the actuated collecting register assembly SR1 to SR16. For example, if one depresses the actuating element PS1, control voltage is applied to the selector switches W1, W8 and W25. If the actuating element PS1 is thereupon released (opened), the program which is determined by the individual register assembly ER is continued. If another one of the actuating elements PS1 to PS16 is depressed, one obtains the corresponding register program. If desired, the actuating elements PS1 to PS16 can be mechanically or electrically linked in such a way that the depression (operation) of any one of the actuating elements PS1 to PS16 results in automatic opening of the other actuating elements.

Figure 2:
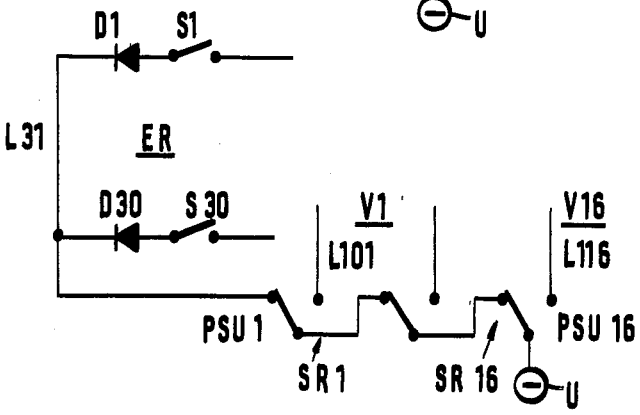
FIG. 2 illustrates a modification of a portion of the register arrangement.

FIG. 2 shows that the inverter 8 can be omitted if the actuating elements PSU1 to PSU16 of the collecting register assemblies SR1 to SR16 constitute switchover devices. If none of the switchover devices PSU1 to PSU16 are actuated, the control conductors receive control voltage by way of the individual register assembly ER. However, as soon as one actuates one of the switchover devices PSU1 to PSU16, the previously mentioned mode of voltage supply is terminated and control voltage is applied to one of the input conductors L101 to L116. It is preferred to mechanically link the switchover devices PSU1 to PSU16 in a manner as mentioned above in connection with the actuating elements PS1 to PS16.

FIG. 3 illustrates one embodiment of the collecting register assemblies SR1 to SR16. A base plate 9 supports sixteen sockets St1 to St16 each of which comprises 32 connectors Bu1 to Bu32. The underside of the base plate 9 carries conductors Lb1 to Lb31 which are soldered to pin-shaped terminals located close to the front edge of the base plate. The terminals can be connected with the control conductors L1 to L30 and with the collecting conductor L31. The connector Bu32 is attached to a pin-shaped terminal which can be connected to one of the input conductors L101 to L116. Each of the sockets St1 to St16 is associated with an insertable card 10 having terminal plugs SS1 to SS32 which are receivable in the corresponding connectors Bu1 to Bu32. The plugs SS1 to SS31 constitute outputs which are connected to holes 11 by means of conductors. The plug SS32 constitutes an input which is connected with holes 12 by means of a further conductor. A connecting conductor L202 with a decoupling diode D102 constitutes a bridge element which can couple associated pairs of holes 11 and 12. In this manner, one can apply control voltage to a predetermined combination of control conductors L1 to L30 respectively, the collecting conductor L31 on closing of the actuating element PS2. The base plate 9 provides room for 16 different register programs. If this does not suffice, one can simply replace some of the cards 10 in order to select different register programs with other combinations of bridge elements.

FIG. 4 shows that the control conductors L1 to L30 are connected with a corresponding number of inputs/outputs of a signal processing circuit 13. The circuit 13 is connected with the inputs/outputs of a random access memory (RAM) data storage circuit 14 by way of a corresponding number of information channels K1 to K30. A switchover device 15 is provided to set the signal processing circuit 13 as well as the data storage circuit 14 for reception or emission of signals. The data storage circuit 14 further comprises four inputs E1 to E4 which are connected with the outputs of a binary encoding device 16. The encoding device 16 has sixteen inputs to which voltage can be applied by way of the corresponding actuating elements PS1 to PS16. The number of the addressed input of the binary encoding device 16 is converted into a binary number which is transmitted by way of the four addressing inputs for determination of the address in the storing area of the data storage circuit 14.

In order to store the register programs, the switchover device 15 is set for "input." In the next step, a storage area is selected by actuation of one of the elements PS1 to PS16. In a further step, voltage is applied to selected control conductors L1 to L30 by way of the individual register assembly ER. Such voltages are converted in circuit 13 into a signal level which is appropriate for the data storage circuit 14 and are thereupon transmitted, as information signals, to the data storage circuit 14. The other storage areas can be filled in a similar manner. When a register program is to be switched on, the switchover device 15 must be set for "emission." By actuating one of the elements PS1 to PS16, one addresses a storage area in the circuit 14. The corresponding information is then available at the signal processing circuit 13 by way of the channels K1 to K30. The information is raised to the level of control voltage so that control voltage is applied to the corresponding combination of control conductors L1 to L30. On actuation of another actuating element, one obtains a different combination. In this circuit too, the individual register assembly can be rendered ineffective by way of actuating elements PS1 to PS16 through an inverter.

FIG. 5 shows that the actuating means need not consist of switches (PS1 to PS16). Instead, such switches can be consolidated into a counter Z1 which receives control signals from a pulse generator I1 and, while counting, applies voltage to successive outputs thereof. Such voltage is transmitted to the inputs of the binary encoding device 16 which is thereupon operated in the same way as described in connection with FIG. 4.

FIG. 6 shows that a binary counter Z2 can replace the actuating elements PS1 to PS16 as well as the binary encoding device 16. The binary counter Z2 is switched by control pulses. The control pulse transmitting conductor includes a three-position switch 17 which can be actuated to render effective any one of the pulse generators I2, I3 and I4.

The four outputs of the binary counter Z2 transmit voltages which correspond to a binary number in dependency on the number of pulses transmitted to Z2.

It is now assumed, by way of example, that the pulse generator I1 is a manually depressible key, that the pulse generator I2 is a switching clock which transmits pulses at predetermined preferably adjustable intervals, that the pulse generator I3 is a rhythm apparatus which transmits a pulse in response to a predetermined number of timing pulses, and that the pulse generator I4 operates with manual release.

FIG. 4 shows that all of the illustrated parts constitute the collecting register assemblies SR1 to SR16 whereby the parts 13–15 constitute essentially the distributor circuits V1 to V16 which are connected with the actuating elements PS1 to PS16 by way of the binary encoding device 16.

FIG. 7 illustrates the deck of an electronic organ incorporating the present invention. The organ includes a keyboard 18. The individual actuating elements, switches S1 to S30, are located at a level above the manual keyboard 18 behind a shield or shroud. The switches for various footages are actuated by latches 19, and the switches for various tone formations are actuated by toggles 20. Light-emitting diodes LD1 to LD30 are disposed above each of the toggles 20. Other actuating elements, such as drawbars 21, can also extend forwardly through the shroud. A panel which is disposed at one side of the manual keyboard 18 is provided with two rows of keys 22 each of which is associated with one of the collecting register assemblies SR1 to SR16.

Thus, in accordance with the above, the aforementioned objects are effectively attained.

What is claimed:

1. In an electronic musical instrument, the combination of (a) a tone generator (1) adapted to produce tone signals;

(b) means (2) for selecting said tone signals;

(c) functional units (F1–F30) for influencing said tone signals;

(d) a discrete electronic selector switch (W1–W30) in controlling relationship with each of said functional units;

(e) a discrete control conductor (L1–L30) in controlling relationship with each of said selector switches;

(f) an individual register assembly (ER) having first actuating elements (S1–S30) each operatively connected to one of said control conductors to apply control voltage (from $\overline{L31}$) thereto; and (g) a plurality of collecting register assemblies (SR1–SR16) each having a second actuating element (PS1–PS16 or PSU1–PSU16) and an associated distributor circuit (V1–V16), each of said distributor circuits being connected to a different combination of control conductors and being energizable by the respective second actuating element to apply control voltage simultaneously to the corresponding combination of selector switches.

2. The combination of claim 1, wherein each of said distributor circuits comprises means (10 or 14) for varying the combination of control conductors which are connected thereto.

3. The combination of claim 1, wherein said selector switches include first selector switches (W1–W20) for tone signals and second selector switches (W21–W30) for sound effects, at least one of said distributor circuits including means for connecting the respective second actuating element with said first and second selector switches.

4. The combination of claim 1, wherein said selector switches include first selector switches (e.g., W16–W20) for high footages and second selector switches (e.g., W1–W5) for low footages, at least one of said distributor circuits including means for connecting the respective second actuating element to said first and second selector switches.

5. The combination of claim 1, further comprising a common supply conductor ($\overline{L31}$) and a plurality of decoupling elements (D1–D30), one for each of said control conductors, said first actuating elements (S1–S30) comprising switches each of which connects said common supply conductor with a control conductor through the respective decoupling element and said second actuating elements (PS1–PS16) being arranged to apply control voltage to said common supply conductor or to the outputs of the corresponding distributor circuits, said outputs being connected with the respective combinations of control conductors.

6. The combination of claim 5, wherein each of said second actuating elements (PSU1–PSU16) is a switchover device which applies control voltage either to said common supply conductor or to the respective distributor circuit.

7. The combination of claim 5, further comprising an additional collecting conductor (L31) and an inverter (8) connecting said additional collecting conductor with said common supply conductor, said second actuating elements (PS1–PS16) being operative to energize the respective distributor circuits and to simultaneously connect said additional collecting conductor to the corresponding collecting register assemblies.

8. The combination of claim 5, wherein each of said distributor circuits comprises a connecting conductor (L201–L216) provided with a decoupling element (D101–D116) and connected to the respective control conductor, each of said second actuating elements (PS1–PS16) including a switch which applies control voltage to the respective connecting conductor.

9. The combination of claim 1, wherein each of said distributor circuits comprises at least one card (10) which includes an input (SS32) for the application of control voltage in dependency on the condition of the respective second actuating element (PS1–PS16) and outputs (SS1–SS30) for connection with the respective control conductors, and bridge elements (D102) connecting a preselected combination of said outputs with said input.

10. The combination of claim 9, wherein said bridge elements are decoupling diodes.

11. The combination of claim 1, wherein said distributor circuits comprise a data storage device (14) having storage areas adapted to be addressed by way of the respective second actuating elements (PS1–PS16), said storage areas accepting during transmission of information thereto such information which corresponds to the combination of control conductors to which control voltage is applied and said control voltage being applied to the corresponding control conductors when said storage device transmits information.

12. The combination of claim 11, wherein said storage device comprises a RAM-data storing device having a plurality of inputs/outputs each of which is associated with one of said control conductors and further comprising a signal processing circuit (13) interposed between said inputs/outputs and the respective control conductors.

13. The combination of claim 11, wherein said data storage device comprises a plurality of addressing inputs (E1–E4) for binary signals and further comprising a binary encoding device (16) having a plurality of inputs for reception of signals from corresponding second actuating elements (PS1–PS16) and means for converting such signals into binary signals.

14. The combination of claim 13, wherein said second actuating elements together constitute a counter (Z1) which can be driven by control switching impulses and includes a series of outputs connected with corresponding inputs of said binary encoding device (16).

15. The combination of claim 13, wherein said binary encoding device and said second actuating elements (PS1–PS16) together constitute a binary counter (Z2) adapted to be driven by control switching pulses and having outputs connected with different addressing inputs of said data storage device.

16. The combination of claim 1, further comprising a plurality of light-emitting devices (LD1–LD30), one for each of said control conductors and each connected with the respective control conductor to denote the associated selector switch when the respective control conductor transmits a signal.

17. In a register arrangement for an electronic musical instrument of the type wherein tone signals produced by a tone generator (1) are selected by means of keys (2) or the like and are transmitted to a loudspeaker (6) by way of an amplifier (5) and wherein a plurality of functional units (F1–F30) are adapted to influence the tone signals and can be rendered effective by means of selector switches (W1–W30), the improvement which consists in that said selector switches are electronic switches having control inputs and in the provision of (a) means for rendering said selector switches operative, including discrete control conductors (L1–L30) for applying control voltage (U) to the control inputs of said selector switches;

(b) an individual register assembly (ER) which includes a plurality of first actuating elements (S1–S30) for selection of one control conductor each;

(c) a plurality of collecting register assemblies (SR1–SR16) each of which comprises a distributor circuit (V1–V16) for selection of a predetermined combination of control conductors, and second actuating elements (PS1–PS16 or PSU1–PSU16) for energizing the respective distributor circuits; and (d) a control voltage source (U) which is connectable with said first actuating elements as well as with said second actuating elements so that, on operation of a first actuating element, control voltage is applied to one control conductor whereas, on operation of a second actuating element, control voltage is applied to a combination of control conductors.

* * * * *